US006394863B1

(12) United States Patent
Chen

(10) Patent No.: US 6,394,863 B1
(45) Date of Patent: May 28, 2002

(54) FIN WITH MOVABLE FLAP

(76) Inventor: Chien-Rung Chen, P.O. Box 82 144, Taipei (TW)

( * ) Notice: Subject to any disclaimer, the term of this patent is extended or adjusted under 35 U.S.C. 154(b) by 0 days.

(21) Appl. No.: 09/685,216

(22) Filed: Oct. 11, 2000

(51) Int. Cl.[7] ..... A63B 31/08
(52) U.S. Cl. ..... 441/64
(58) Field of Search ..... 441/55, 60–64, 441/65, 76, 77; D21/806, 807, 678

(56) References Cited

U.S. PATENT DOCUMENTS

| | | | | | |
|---|---|---|---|---|---|
| 802,306 | A | * | 10/1905 | McKittrick | 441/61 |
| 1,590,484 | A | * | 6/1926 | Volker | 441/64 |
| 2,889,563 | A | * | 6/1959 | Lamb et al. | 441/64 |
| 3,055,025 | A | * | 9/1962 | Ferraro et al. | 441/64 |
| 3,422,470 | A | * | 1/1969 | Mares | 441/64 |
| 5,125,860 | A | * | 6/1992 | Tsai | 441/64 |
| 6,126,503 | A | * | 10/2000 | Viale et al. | 441/64 |

FOREIGN PATENT DOCUMENTS

| | | | | |
|---|---|---|---|---|
| CH | 204540 | * | 8/1939 | 441/61 |
| DE | 1075997 | * | 2/1960 | 441/61 |
| DE | 246705 | * | 6/1987 | 441/64 |
| FR | 2269980 | * | 12/1975 | 441/64 |
| FR | 2654640 | * | 5/1991 | 441/64 |
| IT | 444567 | * | 10/1949 | 441/64 |

* cited by examiner

*Primary Examiner*—S. Joseph Morano
*Assistant Examiner*—Ajay Vasudeva
(74) *Attorney, Agent, or Firm*—A & J

(57) ABSTRACT

A fin has a blade provided with a hole and a one-way movable flap having a fixing edge connected to an inner margin of the blade and a moving edge overlapping an outer margin of the blade to close the hole on the blade. When a diver alternately sweeps two legs up and down under water, the movable flap on the fin worn on the upward swept leg is pushed downward by the resistance from the water to open the hole. The same resistance vanishes when the hole is opened, allowing the diver to sweep the leg upward with reduced effort. On the other hand, the flap on the fin worn on the downward swept leg is pushed upward by the resistance from the water to close the hole, allowing the diver to kick water more powerfully and advance more quickly.

3 Claims, 8 Drawing Sheets

FIN WITH MOVABLE FLAP

FIELD OF THE INVENTION

The present invention relates to a fin, and more particularly to a fin with movable flap. The flap is pushed by water to open a hole on a blade of the fin when a diver sweeps a leg upward, allowing the diver to sweep the leg upward with reduced effort. And the flap is pushed by water to close the hole on the blade when the diver's leg is swept downward, allowing the diver to kick water more powerfully and advance under water more quickly.

BACKGROUND OF THE INVENTION

It is known that a diver would alternately sweep two legs upward and downward like swimming in free stroke in order to advance under water. However, as a matter of fact, it is only the downward swept leg that kicks water to cause a flat blade of a fin worn on that leg to resist water and therefore propels the diver forward. The other leg is upward swept only to prepare for a next kick of water.

A conventional fin typically includes a solid and flat blade. When the diver sweeps one leg upward, the blade of the fin worn on that leg encounters a downward water resistance that does not help but rather hinder the diver in his or her forward movement. Under this condition, it would be difficult for the diver to alternately move two legs at large sweep angle to advance under water quickly. Moreover, human's leg is so structured that it tends to more easily kick forward than extend backward and upward. The downward water resistance against the blade of the fin on the diver's upward swept leg would therefore easily harm the diver by causing a cramped leg and largely consumed body strength.

Furthermore, in diving from a boat or a bank, there is a considerably big force generated at the instant the flat blade contacts with water. This strong force acting on the flat blade of the fin is borne by the diver's ankle. In the event the diver enters the water at an unfavorable angle, the ankles would be easily sprained and the diver tends to lose balance and collide his head against the boat or bank to cause serious result.

Therefore, it is desirable to develop an improved fin to eliminate the above-mentioned problems in diving.

SUMMARY OF THE INVENTION

A primary object of the present invention is to provide a fin that enables a diver to advance under water with reduced effort.

To achieve this and other objects, the fin according to the present invention mainly includes a blade provided with one or more holes and one or more one-way movable flaps connected to the blade to cover the hole or holes on the blade. The flap each has a moving edge opposite to the fixing edge to movably overlap the blade. When a diver alternately sweep two legs up and down under water, the movable flap on a top surface of the fin worn on the upward swept leg is pushed downward by the resistance from the water to open the hole. The same resistance vanishes when the hole is opened, allowing the diver to sweep the leg upward with reduced effort. On the other hand, the flap on the fin worn on the downward swept leg is pushed upward by the resistance from the water to close the hole, allowing the diver to kick water more powerfully and advance more quickly.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
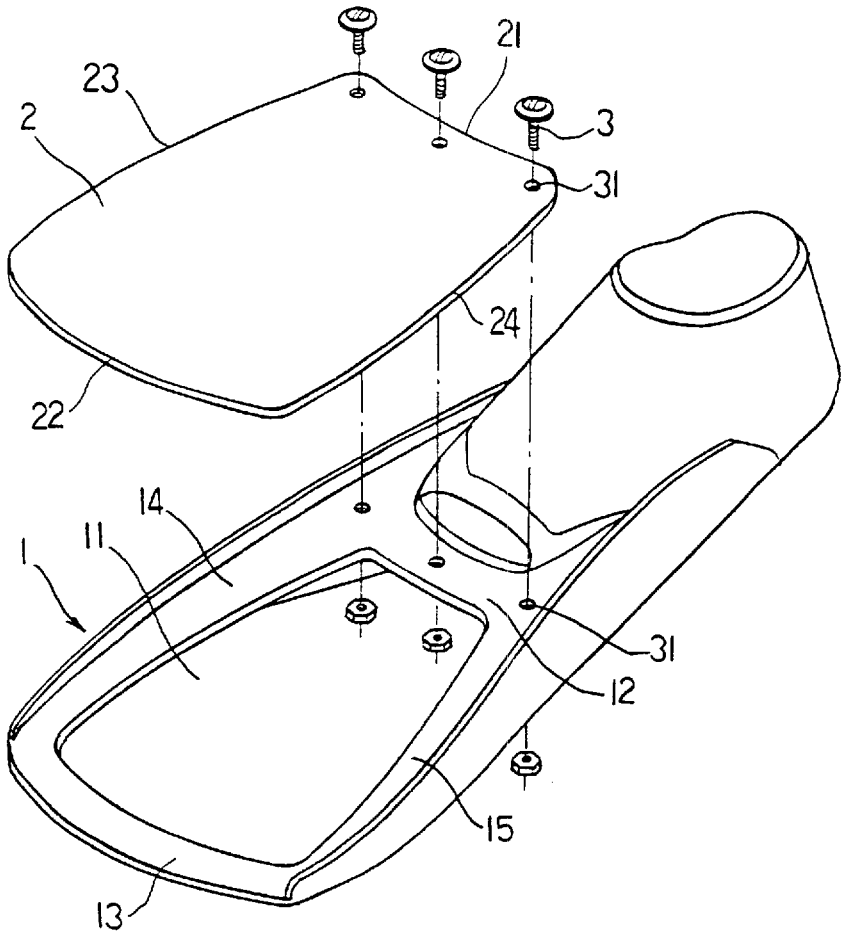
FIG. 1 is an exploded perspective of a fin with movable flap according to a preferred embodiment of the present invention.
Figure 2:
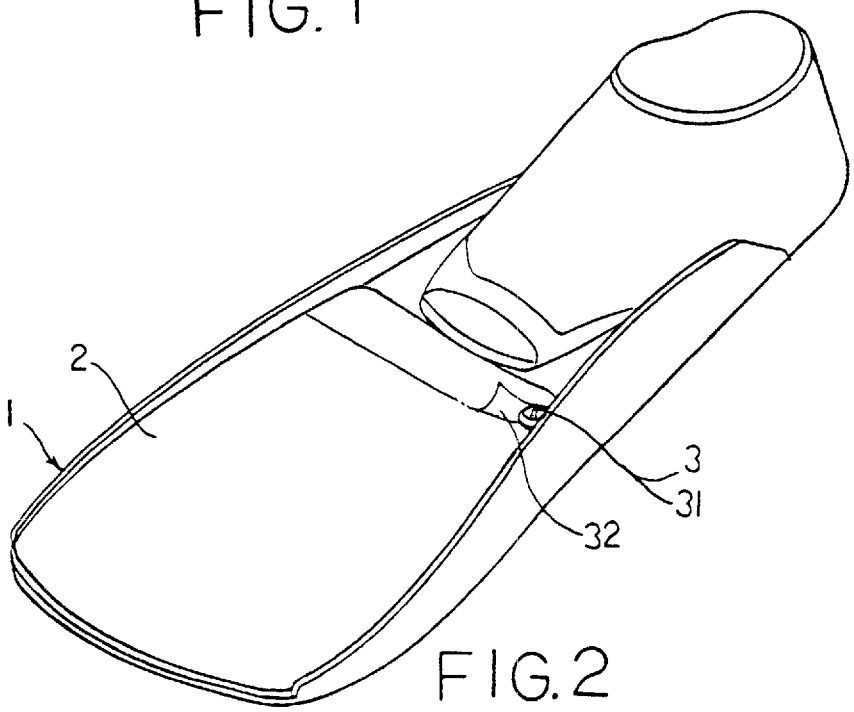
FIG. 2 is an assembled perspective of the fin of FIG. 1.

Please refer to FIGS. 1 and 2 that are exploded and assembled perspective views, respectively, of a fin with movable flap according to a preferred embodiment of the present invention. As shown, the fin mainly includes a flat blade 1 having a hole 11, and a movable compensation flap 2 having dimensions slightly larger than that of the hole 11. For simplicity, the movable compensation flap 2 will be referred to as the movable flap 2 or the flap 2 hereinafter.

Figure 3:
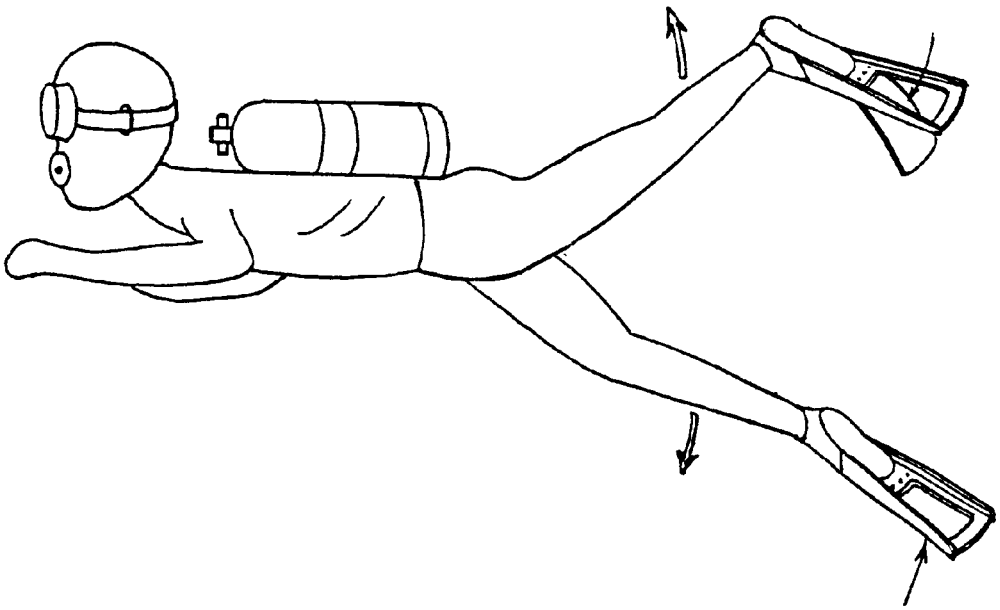
FIG. 3 shows the operation of the movable flap on the fin of FIG. 2.

Portions of the blade 1 surrounding the hole 11 include an inner margin 12 adjacent to an inner edge of the hole 11, an outer margin 13 adjacent to an outer edge of the hole 11, and two side margins 14, 15 adjacent to two lateral edges of the hole 11. The flap 2 has a fixing edge 21 at where a plurality of connecting holes 31 are formed. The inner margin 12 of the blade 1 is provided with connecting holes 31 corresponding to those provided on the fixing edge 21 of the flap 2, such that the flap 2 is movably connected to the blade 1 by suitable fastening means 3 threaded through the connecting holes 31 to normally close the hole 11. It is understood that the flap 2 may also be movably connected to the blade 1 in many other suitable manners. Another edge of the flap 2 opposite to the fixing edge 21 is a moving edge 22. The moving edge 22 and two lateral edges 23, 24 of the flap 2 are adapted to overlap the outer margin 13 and the lateral margins 14, 15 of the blade 1, respectively, when the flap 2 closes the hole 11. Please refer to FIG. 3. When a diver wearing fins of the present invention to alternately sweep two legs upward and downward under water to drive him or her forward, the movable flap 2 on the fin worn on the feet of the upward swept leg is pushed downward by the resistance from the water to open the hole 11. The same resistance pushing the movable flap 2 vanishes when the hole 11 is opened and therefore allows the diver to easily upward sweep the leg with reduced energy to complete the preparatory movement for a next kick of water to propel the diver. On the other hand, the flap 2 on the fin worn on the feet of the downward swept leg is pushed upward by the resistance from the water to close the hole 11, allowing the diver to kick water more powerfully and drive him or her forward more quickly. The opened hole 11 allows the diver's legs to alternately move upward and downward at increased sweep angle, enabling the downward leg to more powerfully kick water to more quickly advance the diver at each kick of water.

The provision of connecting holes 31 and fastening means 3 allows convenient replacement of flaps 2 of, for example, different colors or shapes to make the fins changeful and attractive in their appearances. Decorative strips 32 may be used to cover areas having the connecting holes 31 and fastening means 3 provided thereat, so as to enhance the appearance of the fins.

The shapes and dimensions and the numbers of the hole 11 and the movable flap 2 are optional depending design and personal preference. Some other embodiments of the fin of the present invention will now be described below.

Embodiment No. 1

Figure 4:
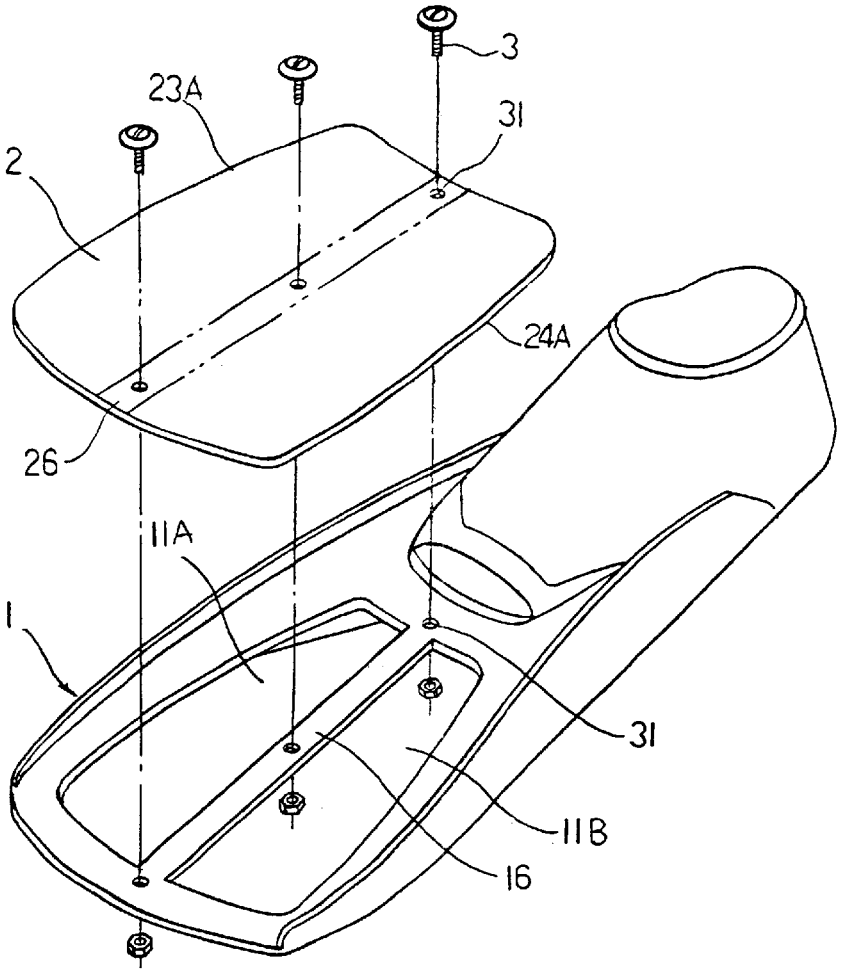
FIG. 4 is an exploded perspective of a fin with movable flaps according to another embodiment of the present invention.
Figure 5:
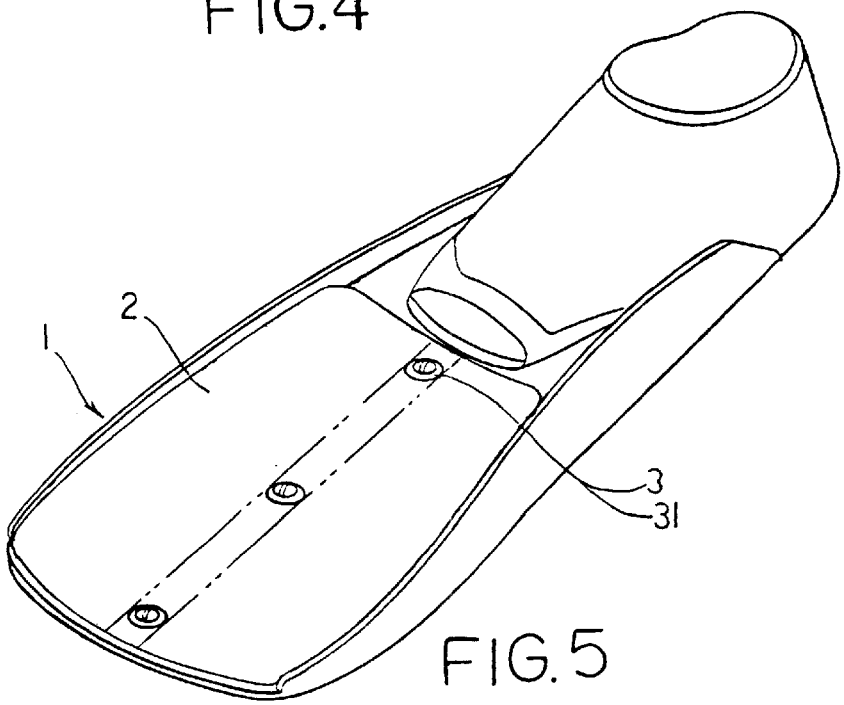
FIG. 5 is an assembled perspective of the fin of FIG. 4.

FIGS. 4 and 5 illustrate a fin with movable fin according to another embodiment of the present invention. In this embodiment, the fin includes a blade 1 having two holes 11A, 11B positioned side by side, and a movable compensation flap 2 having dimensions large enough to cover the two holes 11A, 11B.

Figure 6:
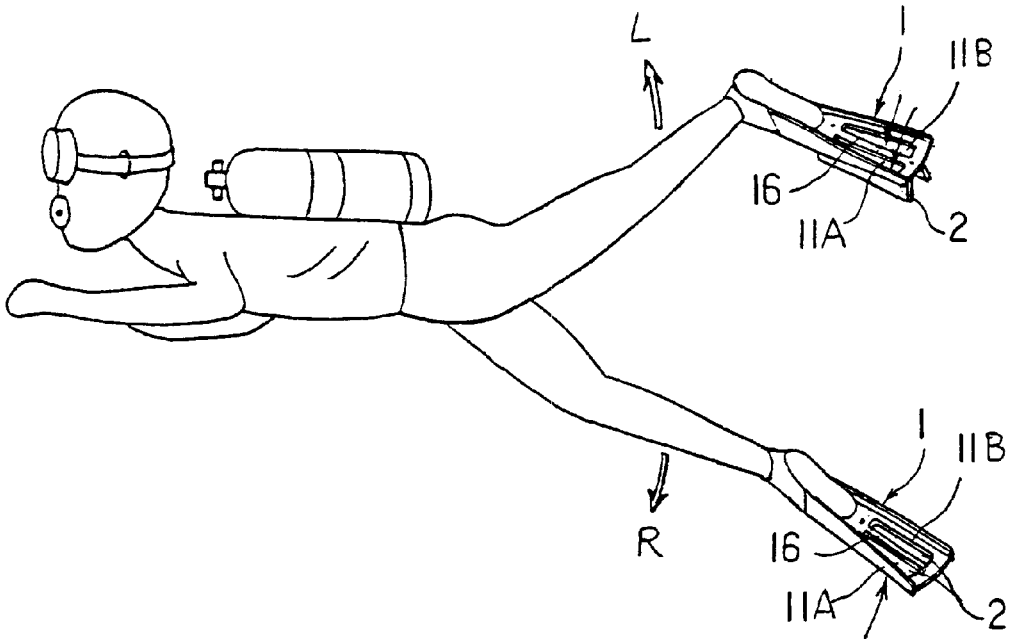
FIG. 6 shows the operation of the movable flaps on the fin of FIG. 5.

Portions of the blade 1 surrounding the holes 11A, 11B include two side margins 14, 15 adjacent to two lateral outer sides of the holes 11A, 11B and a longitudinal middle support 16 between the two holes 11A and 11B. The flap 2 is provided along a centerline thereof with a fixing portion 26 on which a plurality of connecting holes 31 are provided. The middle support 16 of the blade 1 is also provided with connecting holes 31 corresponding to those on the fixing portion 26 of the flap 2, such that the flap 2 is fixed onto the blade 1 by fastening means 3 threaded through the connecting holes 31 to normally close the holes 11A, 11B. In this embodiment, two parts of the flap 2 at two sides of the central fixing portion 26 are pivotally movable relative to the fixing portion 26. Two lateral outer edges 23A, 24A of the flap 2 opposite to the central fixing portion 26 are moving edges adapted to overlap the side margins 14, 15 of the blade 1 when the flap 2 normally closes the holes 11A, 11B. FIG. 6 illustrates the two moving edges 24A, 24B of the movable flap 2 on the fin worn on the feet of the upward swept leg are pushed downward by the resistance from the water to open the holes 11A, 11B, allowing the diver to easily upward sweep the leg at increased sweep angle and with reduced energy. On the other hand, the movable flap 2 on the fin worn on the other downward swept leg is pushed upward by water resistance to close the holes 11A, 11B, allowing the diver to more powerfully kick water and more quickly advance under water.

Embodiment No. 2

Figure 7:
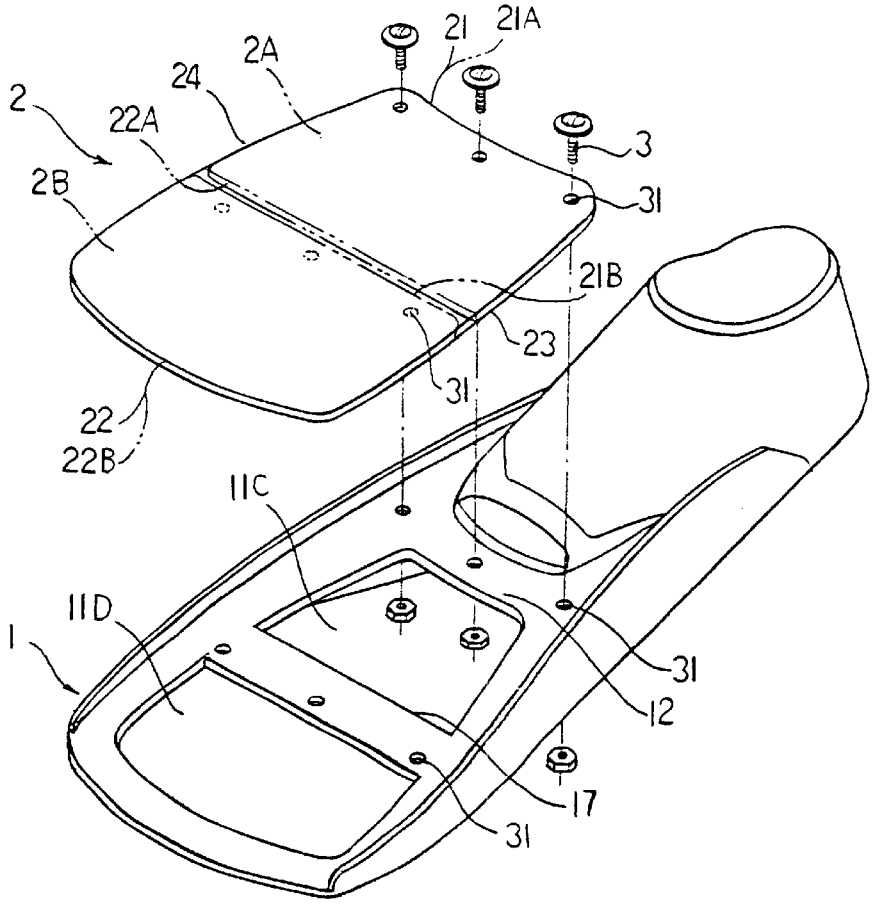
FIG. 7 is an exploded perspective of a fin with movable flaps according to a further embodiment of the present invention.
Figure 8:
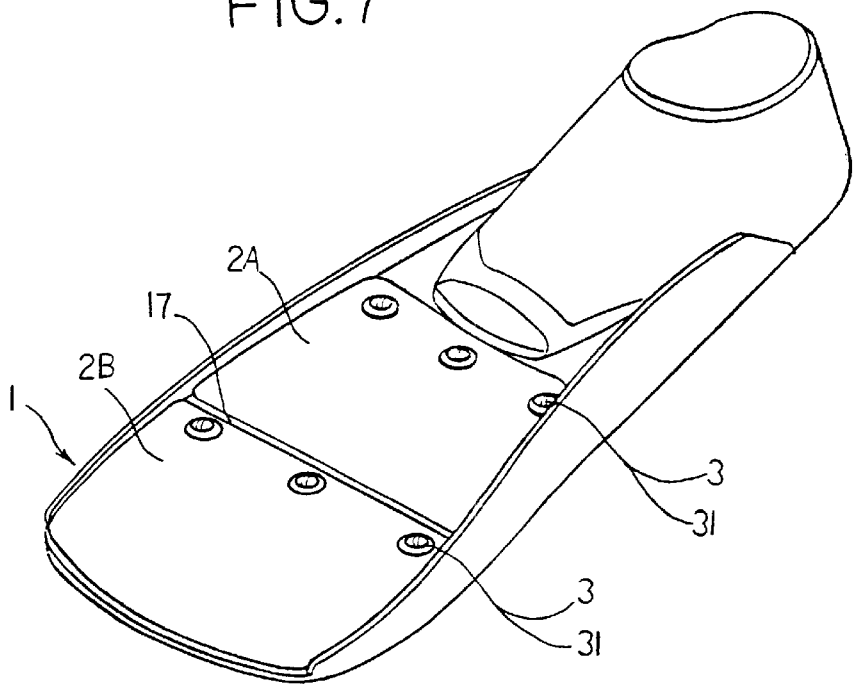
FIG. 8 is an assembled perspective of the fin of FIG. 7.

FIGS. 7 and 8 illustrate a fin with movable flap according to a further embodiment of the present invention. In this embodiment, the fin includes a blade 1 having an inner hole 11C and an outer hole 11D positioned end to end, and a movable compensation flap 2 having dimensions large enough to cover the two holes 11C, 11D.

The flap 2 may be a one-piece member or a two-piece member consisting of two movable parts 2A and 2B. In the case of a one-piece member, the flap 2 is similar to that of the flap 2 in the preferred embodiment of the present invention and is movably connected at the fixing edge 21 to the inner margin 12 of the blade 1 by fastening means 3 threaded through connecting holes 31 correspondingly provided on the fixing edge 21 and the inner margin 12, so that the flap 2 normally closes the holes 11C, 11D.

When the flap 2 closes the holes 11C, 11D, an outer edge or moving edge 22 of the flap 2 overlaps an outer margin 13 of the blade 1. In the case of a two-piece member, the inner and the outer parts 2A, 2B of the flap 2 are respectively connected at their inner edges, that is, the fixing edges 21A and 21B, to the inner margin 12 and a transverse middle support 17 between the two holes 11C, 11D of the blade 1 by fastening means 3 threaded through connecting holes 31 correspondingly provided on the fixing edges 21A, 21B and the inner margin 12 and the transverse middle support 17, so that the two parts 2A, 2B normally close the two holes 11C, 11D. When the two parts 2A, 2B of the flap 2 cover the two holes 11C, 11D, outer edges or moving edges 22A, 22B of the two parts 2A, 2B respectively overlap the transverse middle support 17 and the outer margin 13 of the blade 1.

Figure 9:
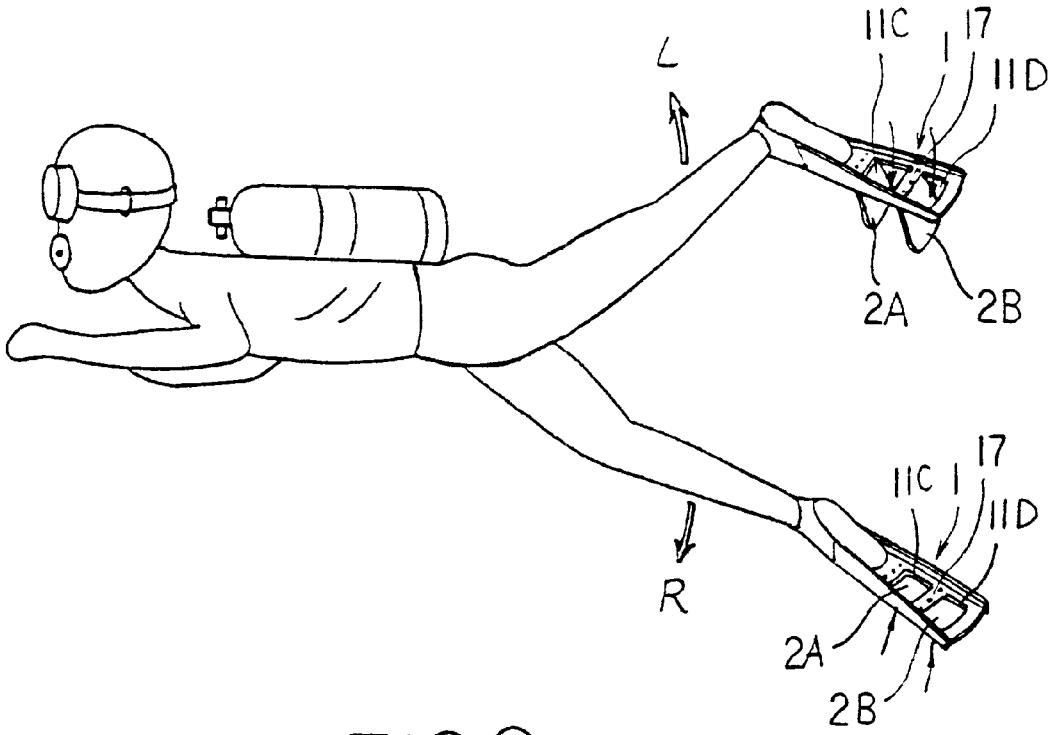
FIG. 9 shows the operation of the movable flaps on the fin of FIG. 8.

FIG. 9 illustrates the two moving edges 22A, 22B of the two movable parts 2A, 2B of the flap 2 on the fin worn on the feet of the upward swept leg are pushed downward by the resistance from the water to open the holes 11C, 11D, allowing the diver to easily upward sweep the leg at increased sweep angle with reduced energy. On the other hand, the movable flap parts 2A, 2B on the fin worn on the other downward swept leg is pushed upward by water resistance to close the holes 11A, 11B, allowing the diver to more powerfully kick water and more quickly advance under water.

It is understood that numbers of the holes 11A, 11B, 11C and 11D on the blade 1 and of the movable compensation flap 2, 2A and 2B illustrated in the above embodiment Nos. 1 and 2 may. be optionally increased as desired.

Embodiment No. 3

Figure 10:
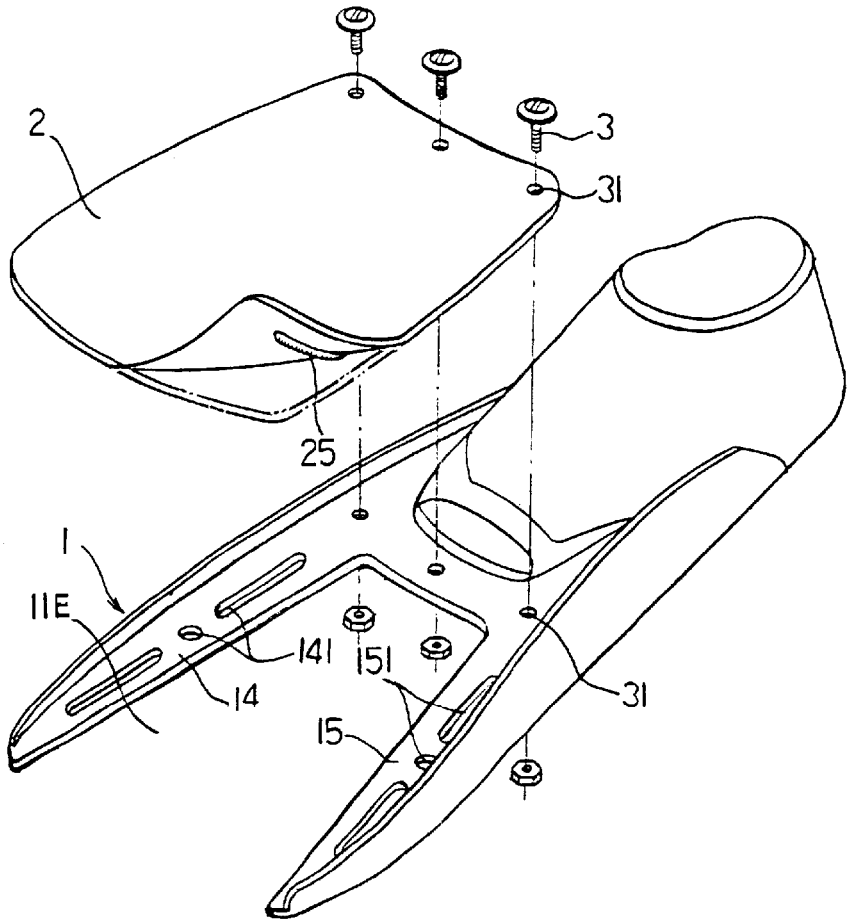
FIG. 10 is an exploded perspective of a fin with movable flap according to a still further embodiment of the present invention.
Figure 11:
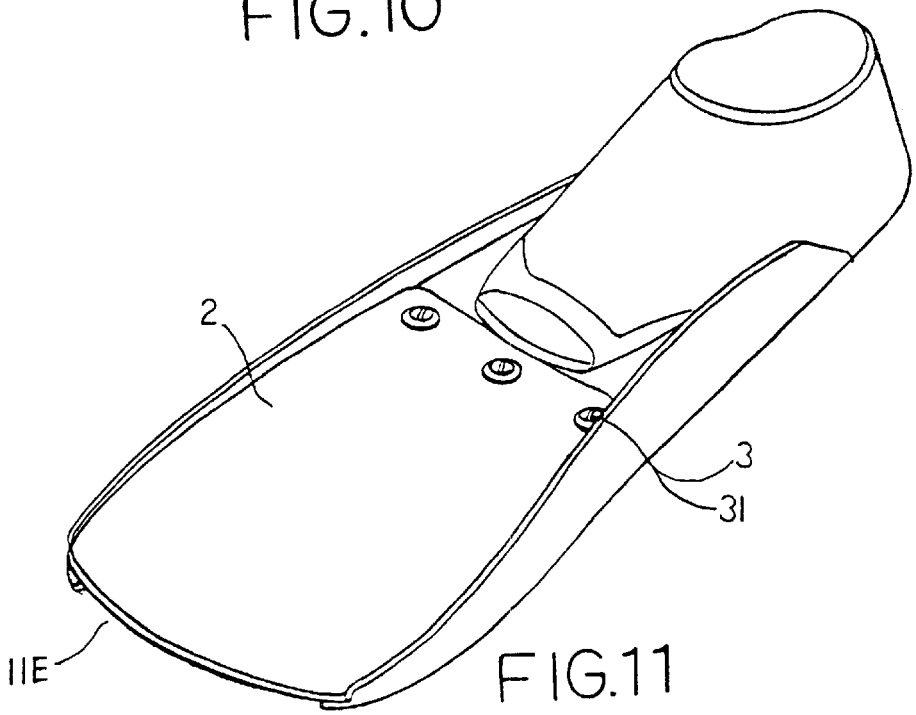
FIG. 11 is an assembled perspective of the fin of FIG. 10.

FIGS. 10 and 11 illustrate a fin with movable fin according to a still further embodiment of the present invention. In this embodiment, the fin includes a blade 1 having an open-front hole 11E, and a movable compensation flap 2 having dimensions large enough to close the hole 11E. The flap 2 is connected at an inner edge or fixing edge 21 to an inner margin 12 of the blade 1 by fastening means 3 threaded through connecting holes 31 correspondingly provided on the fixing edge 21 and the inner margin 12, so that the flap 2 normally closes the open-front hole 11E with two lateral edges of the flap 2 overlapping lateral margins 14, 15 of the blade 1.

The blade 1 is provided at the lateral margins 14, 15 with slots 141 and 151, and the flap 2 is provided at the lateral edges with downward protrusions 25 corresponding to the slots 141, 151. When the flap 2 closes the hole 11E, the protrusions 25 engage with the slots 141, 151. The engagement of the protrusions 25 with the slots 141, 151 prevents the flap 2 from separating from the two lateral margins 14, 15 of the blade 1 due to outward deflection of the lateral margins 14, 15 by an upward water pressure when the leg wearing the fin sweeps downward to kick water.

It is understood that the slots 141, 151 and the corresponding protrusions 25 may be of any shape and/or combinations of different shapes, and that the lateral margins 14, 15 at two sides of the open-front hole 11E may be of any shape.

In the previously described embodiments of the present invention, the flap 2, 2A or 2B is fixed to a top of the blade 1 to be opened in only one direction. The fin with movable flap connected to a top thereof is suitable for a diver who prefers to kick water by upward and downward sweeping two legs like swimming in free stroke. In the event the diver prefers to kick water by bending and stretching two legs forward and backward alternately like swimming in breast stroke, the flap 2, 2A or 2B may be fixed to a bottom of the blade 1 in similar ways as described in the previous embodiments. In either way, the movable flap 2 enables the diver to advance under water more quickly with reduced effort.

Embodiment No. 4

Figure 12:
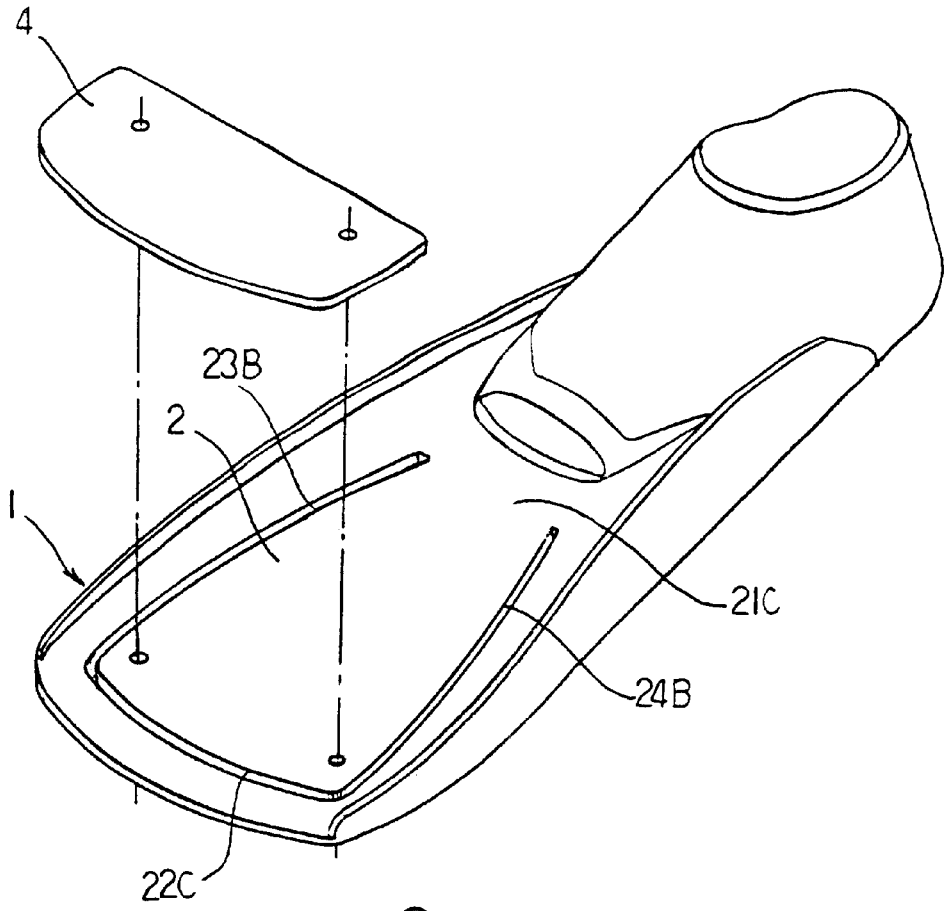
FIG. 12 is an exploded perspective of a fin with movable flap according to a still further embodiment of the present invention.
Figure 13:
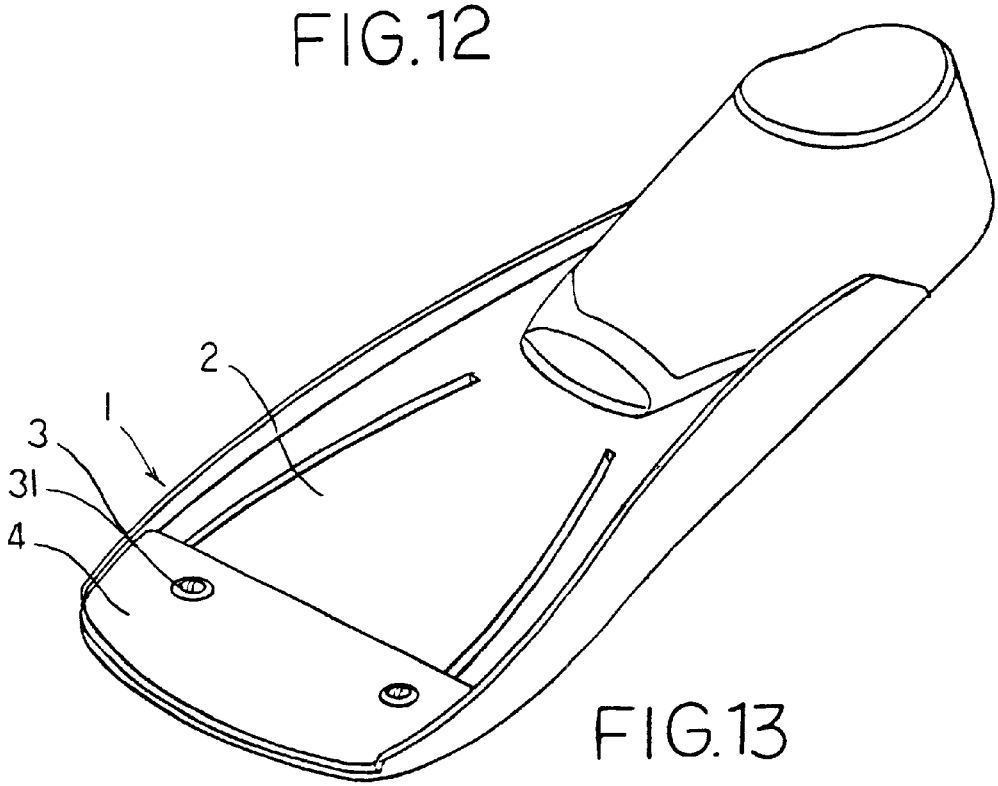
FIG. 13 is an assembled perspective of the fin of FIG. 12.

FIGS. 12 and 13 illustrate a fin with movable fin according to a still further embodiment of the present invention. In this embodiment, the fin includes a blade 1 having a flap 2 integrally connected at an inner fixing edge 21C to the blade 1, and a stopper 4. The flap 2 is formed by providing a continuous narrow slit on the blade 1, so that an outer moving edge 22C and two lateral edges 23B, 24B of the flap 2 are separated from the blade 1. The stopper 4 is connected to the outer moving edge 22C of the flap 2 with its lateral edges overlapping the blade 1, so that the flap 2 is restricted by the stopper 4 to pivotally move about the inner fixing edge 21C only in one direction when the flap 2 is pushed by water. In the illustrated FIGS. 12 and 13, the stopper 4 is connected to the flap 2 by fastening means 3 threaded through connecting holes 31 correspondingly provided on the flap 2 and the stopper 4. However, it is understood the stopper 4 may also be an integral part of the flap 2 or be connected to the flap 2 in many other suitable ways, and the stopper 4 may be located at top or bottom of the blade 1, depending on the diver's actual need as explained in the previous paragraph.

In conclusion, the fin with movable flap according to the present invention has the following advantages:

1. The movable flap may be located at a top or a bottom side of the blade of the fin, depending on the diver's actual need. In the event the diver prefers to alternately sweep two legs upward and downward like swimming in free stroke, the movable flap is fixed to the top of the blade. And, in the event the diver prefers to bend and stretch two legs alternately like swimming in breast stroke, the movable flap is fixed to the bottom of the blade.

2. When the diver upward sweeps or forward bends one leg to prepare for a next kick of water, the movable flap is pushed downward or backward to open the hole on the blade, allowing the blade to encounter minimized water resistance and protecting the diver's leg against cramp.

3. When the diver jumps into water from a boat or a bank, the movable flaps on the fins eliminate the instantaneous resistance at the instant the fins contact with the water, protecting the diver against sprained ankles and unbalanced body that tends to cause undesired collision of the diver against the boat or the bank.

What is claimed is:

1. A fin with movable flap, comprising a blade having a flap integrally connected at an inner fixing edge to said blade, and a stopper; said flap being formed by providing a continuous narrow slit on the blade, so that an outer moving edge and two lateral edges of said flap are separated from said blade; and said stopper being connected to the outer moving edge of said flap to overlap an outer margin of said blade; and said stopper being adapted to locate either at a top surface of said blade in the event a diver wearing said fin prefers to kick water by alternately sweeping two legs upward and downward as swimming in a free stroke, or at a bottom surface of said blade in the event the diver prefers to kick water by bending and stretching two legs forward and backward as swimming in a breast stroke.

2. The fin with movable flap as claimed in claim 1, wherein said stopper is connected to the outer moving edge of said movable flap with fastening means.

3. The fin as claimed in claim 1, wherein said stopper is integrally formed at the outer moving edge of said movable flap.

* * * * *